US008018333B2

(12) United States Patent
Sennett et al.

(10) Patent No.: US 8,018,333 B2
(45) Date of Patent: Sep. 13, 2011

(54) EMERGENCY ALERT NOTIFICATION FOR THE HEARING IMPAIRED

(75) Inventors: DeWayne Allan Sennett, Redmond, WA (US); Brian Kevin Daly, Seattle, WA (US)

(73) Assignee: AT&T Mobility II LLC, Atlanta, GA (US)

( * ) Notice: Subject to any disclaimer, the term of this patent is extended or adjusted under 35 U.S.C. 154(b) by 0 days.

(21) Appl. No.: 12/648,498

(22) Filed: Dec. 29, 2009

(65) Prior Publication Data

US 2010/0107192 A1 Apr. 29, 2010

Related U.S. Application Data

(63) Continuation of application No. 11/553,200, filed on Oct. 26, 2006, now Pat. No. 7,671,732, and a continuation-in-part of application No. 11/472,085, filed on Jun. 21, 2006.

(60) Provisional application No. 60/788,272, filed on Mar. 31, 2006.

(51) Int. Cl.
*G08B 1/08* (2006.01)

(52) U.S. Cl. ..... 340/539.11

(58) Field of Classification Search ..... 340/539.11, 340/601, 691.6, 7.6, 815.4; 455/404.1; 704/271
See application file for complete search history.

(56) References Cited

U.S. PATENT DOCUMENTS

| | | | | |
|---|---|---|---|---|
| 4,052,720 | A | 10/1977 | McGregor et al. | |
| 6,115,596 | A | 9/2000 | Raith et al. | |
| 6,160,989 | A | 12/2000 | Hendricks et al. | |
| 6,377,925 | B1 | 4/2002 | Greene, Jr. et al. | |
| 6,745,021 | B1 | 6/2004 | Stevens | |
| 6,882,837 | B2 | 4/2005 | Fernandez et al. | |
| 7,039,386 | B2 | 5/2006 | Kolsrud | |
| 7,084,775 | B1 * | 8/2006 | Smith | 340/601 |
| 7,233,781 | B2 * | 6/2007 | Hunter et al. | 455/404.1 |
| 7,277,858 | B1 * | 10/2007 | Weaver et al. | 704/271 |
| 7,308,246 | B2 * | 12/2007 | Yamazaki et al. | 455/404.1 |
| 7,460,108 | B2 | 12/2008 | Tamura | |
| 2001/0014971 | A1 * | 8/2001 | Nagashima et al. | 725/46 |
| 2003/0036379 | A1 * | 2/2003 | Nikolai et al. | 455/414 |
| 2003/0050040 | A1 | 3/2003 | Yamazaki et al. | |
| 2003/0069002 | A1 | 4/2003 | Hunter et al. | |
| 2003/0193394 | A1 | 10/2003 | Lamb | |
| 2003/0216133 | A1 | 11/2003 | Poltorak | |
| 2003/0229900 | A1 | 12/2003 | Reisman | |
| 2004/0031058 | A1 | 2/2004 | Reisman | |
| 2004/0034689 | A1 | 2/2004 | Kacalek et al. | |
| 2004/0136408 | A1 | 7/2004 | Tomobe et al. | |
| 2005/0037728 | A1 | 2/2005 | Binzel et al. | |
| 2005/0043066 | A1 | 2/2005 | Seo | |
| 2005/0129185 | A1 * | 6/2005 | McClelland et al. | 379/52 |
| 2005/0131740 | A1 * | 6/2005 | Massenzio et al. | 705/2 |
| 2005/0159132 | A1 | 7/2005 | Wright et al. | |
| 2005/0162267 | A1 | 7/2005 | Khandelwal et al. | |
| 2006/0040639 | A1 * | 2/2006 | Karl et al. | 455/404.1 |
| 2006/0058004 | A1 * | 3/2006 | Dolezal et al. | 455/404.1 |
| 2006/0079199 | A1 | 4/2006 | Thompson | |
| 2006/0178128 | A1 | 8/2006 | Eaton et al. | |
| 2007/0021099 | A1 | 1/2007 | Sato | |
| 2007/0037549 | A1 | 2/2007 | Poltorak | |
| 2008/0037576 | A1 | 2/2008 | Hwang et al. | |

OTHER PUBLICATIONS

U.S. Appl. No. 11/472,078, Advisory Action, dated Sep. 16, 2009, 3 pages.

(Continued)

*Primary Examiner* — Phung Nguyen
(74) *Attorney, Agent, or Firm* — Woodcock Washburn LLP

(57) ABSTRACT

An indication of an emergency alert message is provided to a user, potentially having a disability, via a networked enabled portable device. The emergency alert message is provided via sign language video images indicative of the emergency alert. A notification makes the user aware when broadcast emergency alerts are issued. In various embodiments, the portable device is enabled to receive information about an emergency alert broadcast of which the potentially disabled user should be aware, e.g., from the EAS, and to notify the user of the emergency alert. The user can be automatically taken to the emergency alert information by having the portable device automatically tune to the emergency broadcast information, the user can optionally retrieve the emergency information by tuning to the emergency broadcast channel, and/or the user can otherwise be presented with a reference to the emergency data, such as a link to the information.

15 Claims, 8 Drawing Sheets

OTHER PUBLICATIONS

U.S. Appl. No. 11/472,078, Final Rejection, dated Jul. 23, 2009, 13 pages.
U.S. Appl. No. 11/472,078, Non-Final Rejection, dated Jan. 27, 2009, 11 pages.
U.S. Appl. No. 11/472,078, Non-Final Rejection, dated Jan. 15, 2010, 14 pages.
U.S. Appl. No. 11/472,078, Notice of Allowance, dated Jul. 9, 2010, 4 pages.
U.S. Appl. No. 11/472,085, Final Rejection, dated Dec. 2, 2010, 20 pages.
U.S. Appl. No. 11/472,085, Non-Final Rejection, dated Dec. 30, 2009, 14 pages.
U.S. Appl. No. 11/472,085, Non-Final Rejection, dated Feb. 4, 2009, 9 pages.
U.S. Appl. No. 11/472,085, Non-Final Rejection, dated Jun. 21, 2010, 17 pages.
U.S. Appl. No. 11/472,085, Request for Continued Examination, dated Nov. 23, 2009, 3 pages.
U.S. Appl. No. 11/553,200, Non-Final Rejection, dated Dec. 18, 2009, 8 pages.
U.S. Appl. No. 11/553,200, Notice of Allowance, dated Jul. 17, 2009, 8 pages.
U.S. Appl. No. 11/472,085, Final Rejection, dated Jun. 29, 2009, 12 pages.

* cited by examiner

EMERGENCY ALERT NOTIFICATION FOR THE HEARING IMPAIRED

CROSS REFERENCE TO RELATED APPLICATIONS

This application is a continuation of U.S. patent application Ser. No. 11/553,200, filed Oct. 26, 2006, which issued as U.S. Pat. No. 7,671,732 and is a continuation-in-part of U.S. patent application Ser. No. 11/472,085, filed Jun. 21, 2006, which claims priority to U.S. provisional patent application No. 60/788,272, filed Mar. 31, 2006. U.S. patent application Ser. Nos. 11/553,200 and 11/472,085, and U.S. provisional patent application No. 60/788,272 are incorporated herein by reference in their entirety.

TECHNICAL FIELD

The technical field generally relates to communications systems and more specifically relates to notification and reporting of emergency alerts, such as those issued by the Emergency Alert System ("EAS"), to networked portable devices of users having disabilities.

BACKGROUND

Existing broadcast technologies, such as Cell Broadcast, Multimedia Broadcast/Multicast Service ("MBMS"), and video broadcast, (e.g., Digital Video broadcast-Handheld ("DVB-H"), and MediaFLO), have been proposed to support emergency alert notification(s) to wireless subscribers. A problem with such broadcast technologies is that the end user does not know when an emergency alert is being broadcast, and thus does not know that he or she needs to tune to an appropriate broadcast channel for the emergency alert information. This situation can be exacerbated if the end user has a disability, such as visual impairment, deafness, etc.

SUMMARY

A mechanism for notifying users of EAS (Emergency Alert System) alerts via networked portable devices supporting telephony radio network and/or broadcast technologies does not require ongoing polling of an emergency communication channel. The mechanism provides alerts to end users of networked enabled portable devices such that end users are made aware when emergency alerts are issued. In various embodiments, a portable device is enabled to receive information about an emergency alert of which the user should be aware, e.g., from the EAS, and to notify the user of the portable device of the emergency alert without requiring action by the user. The user may then automatically be taken to the emergency alert information by having the portable device automatically tune to the emergency broadcast information, the user may optionally retrieve the emergency information by tuning to the emergency broadcast channel, or the user may otherwise be presented with a reference to the emergency data (e.g., a link to the information). In one embodiment, the output of the emergency alert is tailored to a physical disability of the user, e.g., hearing impairment, wherein the emergency alert message is provided via a video image, or images, of sign language.

BRIEF DESCRIPTION OF THE DRAWINGS

The foregoing and other objects, aspects and advantages of an emergency notification system for a portable device of a user having a disability will be better understood from the following detailed description with reference to the drawings.

DETAILED DESCRIPTION OF ILLUSTRATIVE EMBODIMENTS

Figure 1:
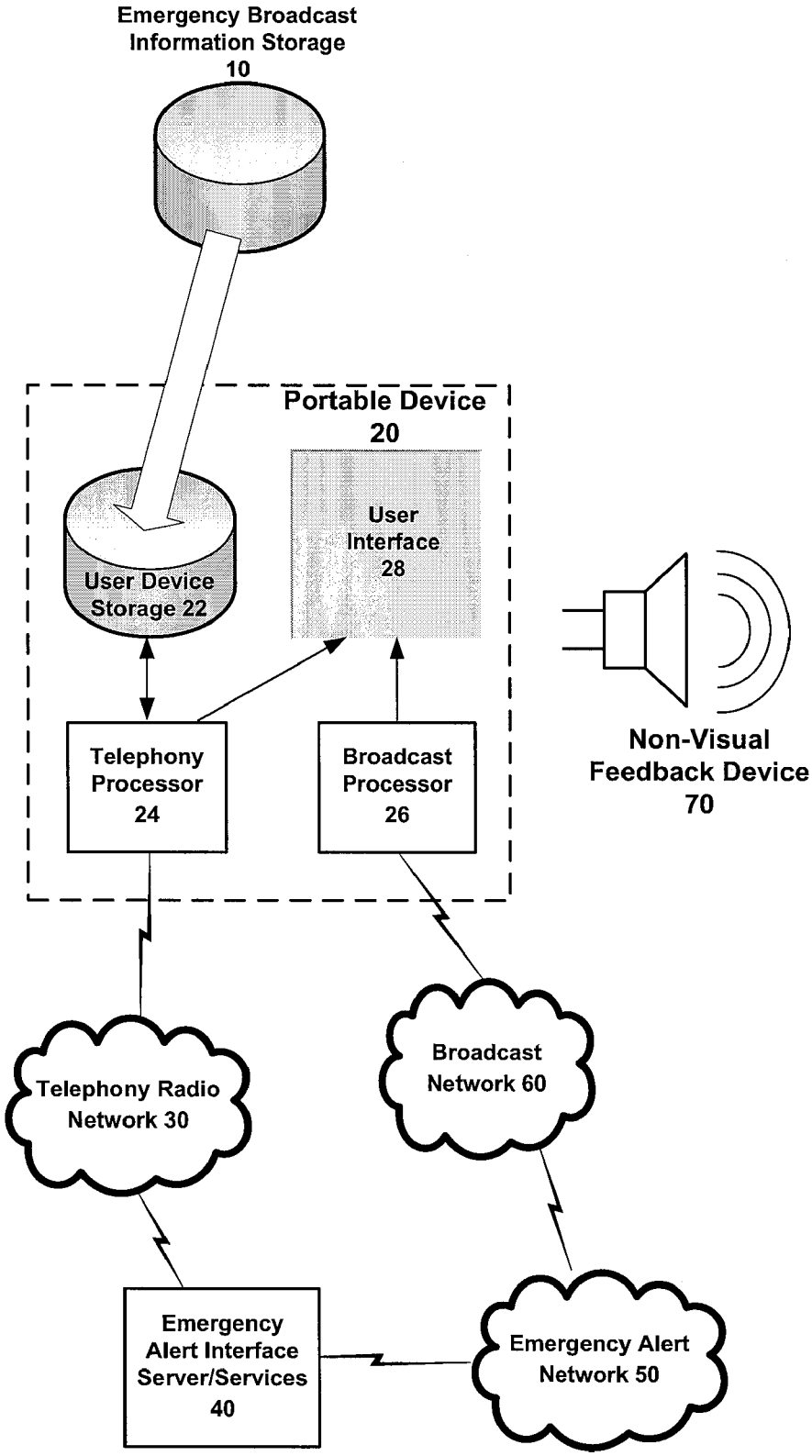
FIG. 1 illustrates an example reporting framework for informing a user having a disability of an emergency broadcast alert via a portable device.

Various embodiments of a notification system for alerting users potentially having disabilities via portable devices (interchangeably referred to as a user devices) of emergencies provide means for a portable device to receive information about an emergency alert of which the user should be aware, e.g., from the EAS, and to notify the user of the portable device of the emergency alert without requiring action by the user. Subsequent to receiving the notification, the user can automatically sense the emergency alert information, retrieve the emergency information by tuning to the emergency broadcast channel, and/or be presented with a reference to the emergency data (e.g., a link to the information) so that a user can otherwise sense the emergency information. In an example embodiment, the emergency alert information is provided in the form of a video image(s) of sign language.

The impact on the battery life of the portable device and the impact on network bandwidth capacity due to implementation of the notification system are minimal because the notification system avoids continuous monitoring of broadcast technologies. Further, the notification system can provide notification to the user in real-time via an emergency alert mechanism which is implemented on the user device, and supported by one or more telephony radio networks.

In an example embodiment, the notification system adds an emergency alert indicator bit on control channel(s) of a telephony network with which the device communicates. When the user device detects the setting of the emergency alert indicator bit on the control channel(s) that it is monitoring, the user device is able to immediately lead the user to the emergency information, or instruct the user with pre-provisioned information about the emergency alert, and any associated broadcast channels that contain the emergency alert. In this fashion, the user device does not have to continuously monitor the broadcast channels for any possible emergency alerts.

In another example embodiment, a Short Message Service ("SMS") message is delivered to the user device via a telephony radio network, which is processed by the user device so that local knowledge is possessed on the portable device that an emergency alert has been issued that is intended for the user of the user device.

In another example embodiment, a message is received, e.g., via an SMS message, control channel, or data channel, which modifies a storage location, e.g., a bit, on the user device when the message is processed. Thus, when modified, the storage location indicates that an emergency alert has been issued that is intended for the user, and the user is notified.

The user may be notified via any one or more types of feedback by the user device, such as visual (e.g., a display of the user device, backlighting, LEDs, etc.), auditory feedback (e.g., an alarm sound) and/or mechanical feedback (e.g., vibration of the phone). In addition, whether displayed automatically or at the option of the user, the emergency alert information can be rendered by the user device via a display (e.g., symbols, pictures, text, video images of sign language, etc.), an audio speaker (e.g., pre-recorded EAS voice message, text-to-speech signal, etc.) and/or any other known form of communication (e.g., Morse code).

In an example embodiment, the notification is rendered such that it is tailored to the user's disability. For a hearing impaired individual, any embodiments that are set up to display only sound, may include means, such as software, on the portable device that transforms the auditory representation to a visual representation. Thus, at least a portion of the information received by the portable device pertaining to the emergency broadcast, can be transformed into a visual representation of notification. For example the portable device can utilize speech recognition techniques to transform the auditory representation to a visual representation. The visual information can be in the form of text and/or video. The resultant text/video can then be provided to the user. In an example embodiment, the user can be taken to a visual link to the emergency information. In an example embodiment, the link comprises at least one video image of a sign language indicative of at least a portion of the emergency alert message. In an example embodiment, the emergency notification is provided via a video image, or images, of sign language. As described in more detail below, video images of sign language can be pre-provisioned in a database of the portable device and/or of a network.

In an example embodiment, mechanical feedback is utilized to notify the user of the emergency broadcast/alert. The mechanical feedback notifies a user that there is an emergency alert that may be relevant to the user (e.g., the user may be interested in the content of the emergency broadcast). Mechanical feedback advantageously is appropriate for users with visual and/or hearing disabilities. Mechanical feedback can be provided alone or in addition to any auditory and/or visual feedback. Mechanical feedback can be in any appropriate form, such as a predefined vibration pattern, for example. The recognition of a pre-defined vibration pattern can be advantageous to all users, with or without disabilities. For example a user may not be paying attention to the display of the portable device, or may be in an environment in which the ambient noise does not allow the user to hear a signal emanating from the portable device.

As shown in the example block diagram of FIG. 1, a portable device 20 is shown for receiving notifications of emergency alert information in accordance with the a notification system for alerting users of portable devices of emergencies. The portable device 20 can comprise any appropriate portable device. For example, portable devices 20 can comprise a mobile devices, a variety of computing devices including (a) portable media players, e.g., portable music players, such as MP3 players, walkmans, etc., (b) portable computing devices, such as laptops, personal digital assistants ("PDAs"), cell phones, portable email devices, thin clients, portable gaming devices, etc., (c) consumer electronic devices, such as TVs, DVD players, set top boxes, monitors, displays, etc., (d) public computing devices, such as kiosks, in-store music sampling devices, automated teller machines (ATMs), cash registers, etc., (e) navigation devices whether portable or installed in-vehicle and/or (f) non-conventional computing devices, such as kitchen appliances, motor vehicle controls (e.g., steering wheels), etc., or a combination thereof Moreover, while some embodiments are directed to systems and methods for use in portable devices, as one of ordinary skill in the art can appreciate, the techniques of the notification system for alerting users of portable devices of emergencies are by no means limited to practice on portable devices, but also can apply to standalone computing devices, such as personal computers ("PCs"), server computers, gaming platforms, mainframes, or the like.

The portable device 20 comprises a storage device 22, a telephony processor 24, and a broadcast processor 26. The storage device 22 is populated with emergency broadcast information from a network-based emergency broadcast information database 10. As one of ordinary skill in the art can appreciate, this information can be provided and updated via over-the-air programming methodologies. Emergency broadcast information can, for instance, include the following types of information: (A) information about available broadcast technologies (e.g., Cell Broadcast, MBMS, DVB-H, MediaFLO, etc.), (B) information concerning which broadcast technologies or network(s), such as broadcast network 60, are specifically supported by the device 20, (C) information about emergency broadcast channels associated with each available broadcast technology, or a combination thereof.

A non-visual feedback device 70, renders non-visual feedback (e.g., auditory feedback such as sounds and/or mechanical feedback such as vibrations) to the user. In an example implementation, based on the configuration of the user/handset as represented in user device storage 22, the portable device 20 automatically, or optionally by user request, contacts the network for an audio version of broadcast. If only a textual version may be received, then the broadcast processor 26 may be provisioned with text-to-speech capabilities in order to present non-visual feedback to the user. User interface 28 renders non-visual feedback via the non-visual feedback device 70 in an appropriate fashion to the user.

Figure 2:
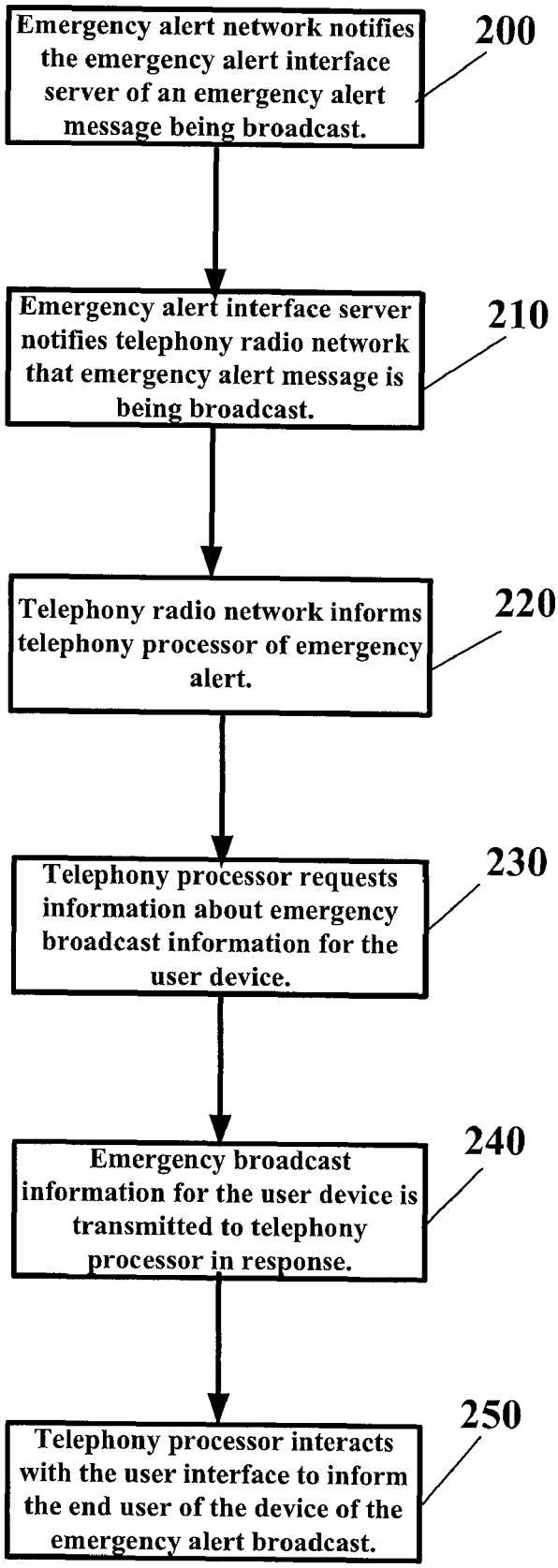
FIG. 2 is a flow diagram of an example process wherein a portable device of a user having a disability becomes aware of an emergency alert.

FIG. 2 is a flow diagram of an example implementation of a process wherein a user device becomes aware of an emergency alert in accordance with the notification system for alerting users of portable devices of emergencies. FIG. 2 is described with reference to FIG. 1. FIG. 2 provides a description of exemplary implementations of various embodiments of the notification system for alerting users of portable devices of emergencies. At step 200, an emergency alert network 50 notifies the emergency alert interface server/services 40, which is communicatively coupled to network 30, such as a carrier network, that an emergency alert message is being broadcast. At step 210, the emergency alert interface server 40 notifies the telephony radio network 30 that an emergency alert is being broadcast using broadcast technologies. At step 220, the telephony radio network 30 informs the telephony processor 24 of portable device 20 that an emergency alert message is being broadcast, e.g., using a predefined, standardized indicator bit on at least one telephony network control channel, an SMS message, a data channel if available, or the like.

At step 230, the telephony network processor 24 on the user device 20 requests the user device database 22 to provide any pre-provisioned information about emergency broadcast information associated with user device 20. In response, at step 240, the user device database 22 returns any one or more of the following non-exhaustive, non-limiting, types of emergency alerting information to the telephony processor 24 on the user device 20: available broadcast technologies (e.g., Cell Broadcast, MBMS, DVB-H, MediaFLO), broadcast technologies supported by the device 20, and/or associated emergency broadcast channels for each available broadcast technology.

At step 250, using the information from the user device 20 retrieved at step 240, the telephony processor 24 interacts with the user interface 28 of the user device 20 to inform the end user that an emergency alert is being broadcast. The user interface 28 is not limited to display of information, however. Any known output device for a user device 20 may be utilized, whether visual, auditory and/or mechanical in operation. For example, special alert tones may be activated and special display graphics, symbols, text, video of sign language, etc. can be portrayed on a display of the user device 20 that inform the user that an emergency broadcast is being sent and to which channel or channels the user should tune for the emergency broadcast. In a non-limiting embodiment, a programmed soft key (or hardware control) may be provided for the end user to access the emergency broadcast immediately, or, optionally, subsequent to receiving notification, the user device 20 may automatically tune to the emergency broadcast.

Figure 3:
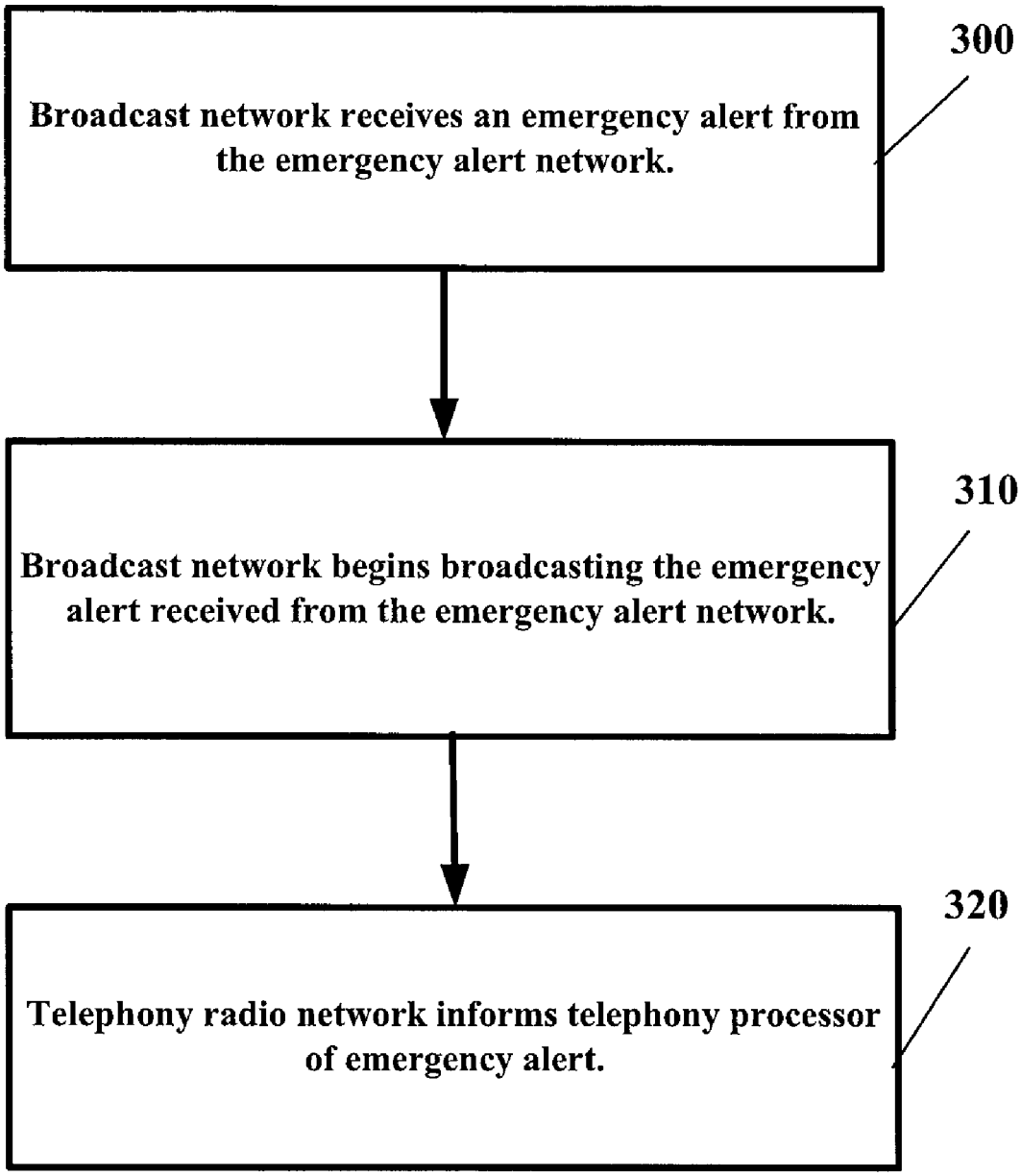
FIG. 3 is a flow diagram of an example process for delivering emergency information via broadcast networks supported by a broadcast processor of the portable device of a user with a disability.

FIG. 3 is a flow diagram of an example process for delivering emergency information. FIG. 3 is described with reference to FIG. 1 and FIG. 2. The process depicted in FIG. 3 can proceed independent of or concurrently with the process depicted in FIG. 2. Emergency information, as depicted in FIG. 3, can be delivered via any broadcast technology supported by the broadcast processor 26 of the user device 20. In FIG. 3, at step 300, the broadcast network(s) 60 receives an emergency alert from the emergency alert network 50, such as the EAS. At step 310, the broadcast network starts broadcasting the received emergency alert. At step 320, whether activation occurs automatically or optionally at the behest of a user that has been notified of the alert (e.g., via the process depicted in FIG. 2), the associated emergency broadcast channel of the user device 20 is activated. The broadcast processor 26 receives the broadcasted emergency alert data and displays the emergency alert via the user interface 28 of the user device 20.

In an example embodiment, an alert message, and/or notification of the alert message is rendered on the portable device in the form of a video image, or video images, of sign language. Sign language can include any appropriate type of sign language, such as American Sign Language (ASL), Old French Sign Language (LSF), Japanese Sign Language (JSL), basic finger spelling, or the like, for example. Information utilized to convert an alert message/notification to a video of sign language can be stored on a database. The database can reside on the mobile device, within a network, or a combination thereof.

Figure 4:
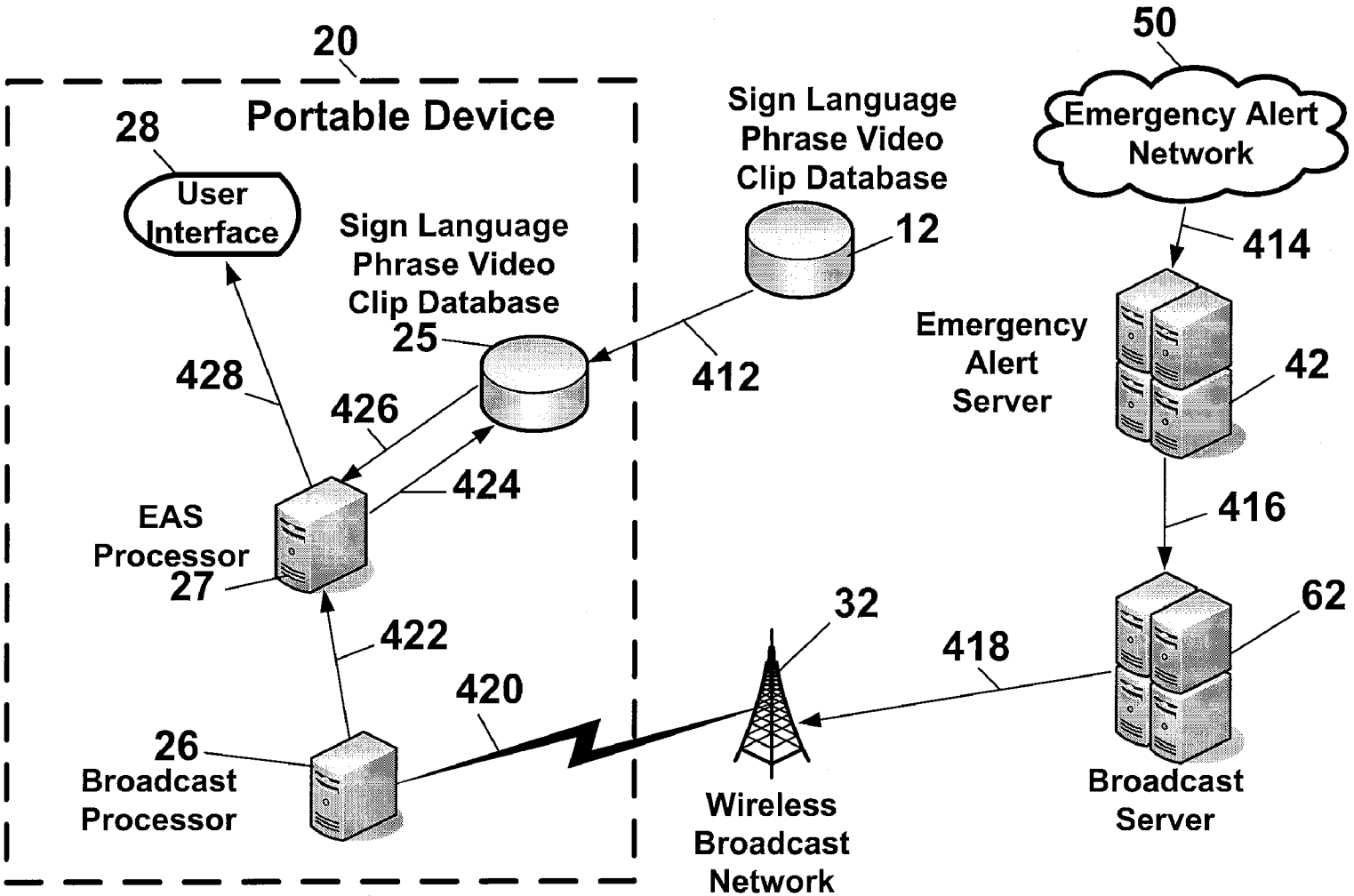
FIG. 4 is a flow diagram of an example terminal based system and process for delivering alert information via sign language.

FIG. 4 is a flow diagram of a terminal (e.g., the portable device 20) based system and process for providing an alert message via sign language. In an example embodiment, the sign language phrase video clip database 25 is provided with the appropriate sign language video clips from a network based sign language phrase video clip database 12 at step 412. The sign language phrase video clip database 25 can be provided with appropriate information, for example, prior to the generation of an emergency alert notification. For example, the sign language phrase video clip database 25 can be provided appropriate sign language video clips, or the like, when a subscriber acquires the portable device 20. Or, in another example, the sign language phrase video clip database 25 can be provide appropriate information after the subscriber acquires the portable device 20 via any appropriate technique such as over-the-air programming. In yet another example, the manufacturer of the portable device 20 can pre-provision the sign language phrase video clip database 22 with the appropriate information, such as sign language video clips. In an example embodiment, the sign language phrase video clip database 25 is part of the user device storage 22 depicted in FIG. 1.

The emergency alert network 50 generates an emergency alert message and sends the alert message to the emergency alert server 42 at step 414. In an example embodiment, the emergency alert server 42 is part of the emergency alert interface server/services 40 depicted in FIG. 1. At step 416, the emergency alert network 50 sends the received emergency alert message to the broadcast server 62 for transmission to the cell sites within the associated alert area. In an example embodiment, the broadcast server 62 is part of the broadcast network 60 as depicted in FIG. 1. The broadcast server 62 sends, at step 418, the emergency alert message to the wireless broadcast network 32 for transmission to the indicated cell sites. In an example embodiment, the wireless network 32 is part of the telephony radio network 30 as depicted in FIG. 1.

The broadcast processor 26 on the portable device 20 receives, at step 420, the emergency alert message from the wireless broadcast network. At step 422, the broadcast processor 26 on the portable device 20 sends the emergency alert message to the EAS processor 27 on the portable device 20. In an example embodiment, the EAS processor 27 is part of the telephony processor 24 as depicted in FIG. 1. The EAS processor 27 extracts the appropriate words, phrases, and the like, from the emergency alert message received at step 422. At step 424, the EAS processor 27 provides a request to the sign language phrase video clip database 25 for the sign language video clip, or clips, corresponding to the extracted words, phrases, and the like. At step 426, the sign language phrase video clip database 25 provides the corresponding video clip(s) to the EAS processor 27.

In an example embodiment, the EAS processor 27 repeats step 424 for each word/phrase in the emergency alert message. That is, the EAS processor 27 requests, for each word/phrase, or the like, a corresponding video clip, or clips, from the sign language phrase video clip database 25. In another example embodiment, the EAS processor 27 provides a request to the sign language phrase video clip database 25, at step 424, for the video clip(s) corresponding to the entire emergency alert message and the sign language phrase video clip database 25 responds, at step 426, with sign language video clips indicative of the entire emergency alert message.

The EAS processor 27 combines the received sign language video clips for the words/phrases into one video clip for the entire emergency alert message. The EAS processor 27 can combine the received video clips in any appropriate manner, such as concatenation, or any other appropriate combining technique. At step 428, the EAS processor 27 provides, to the user interface 28, the combined sign language video clips indicative of the emergency alert message. In an example, the EAS processor 27 provides, to the user interface 28 at step 428, the emergency alert message along with the combined sign language video clips indicative of the emergency alert message. The user interface 28 renders the combined sign language video clips which are indicative of at least a portion of the emergency alert message, which in turn is indicative of at least a portion of the emergency alert broadcast.

Figure 5:
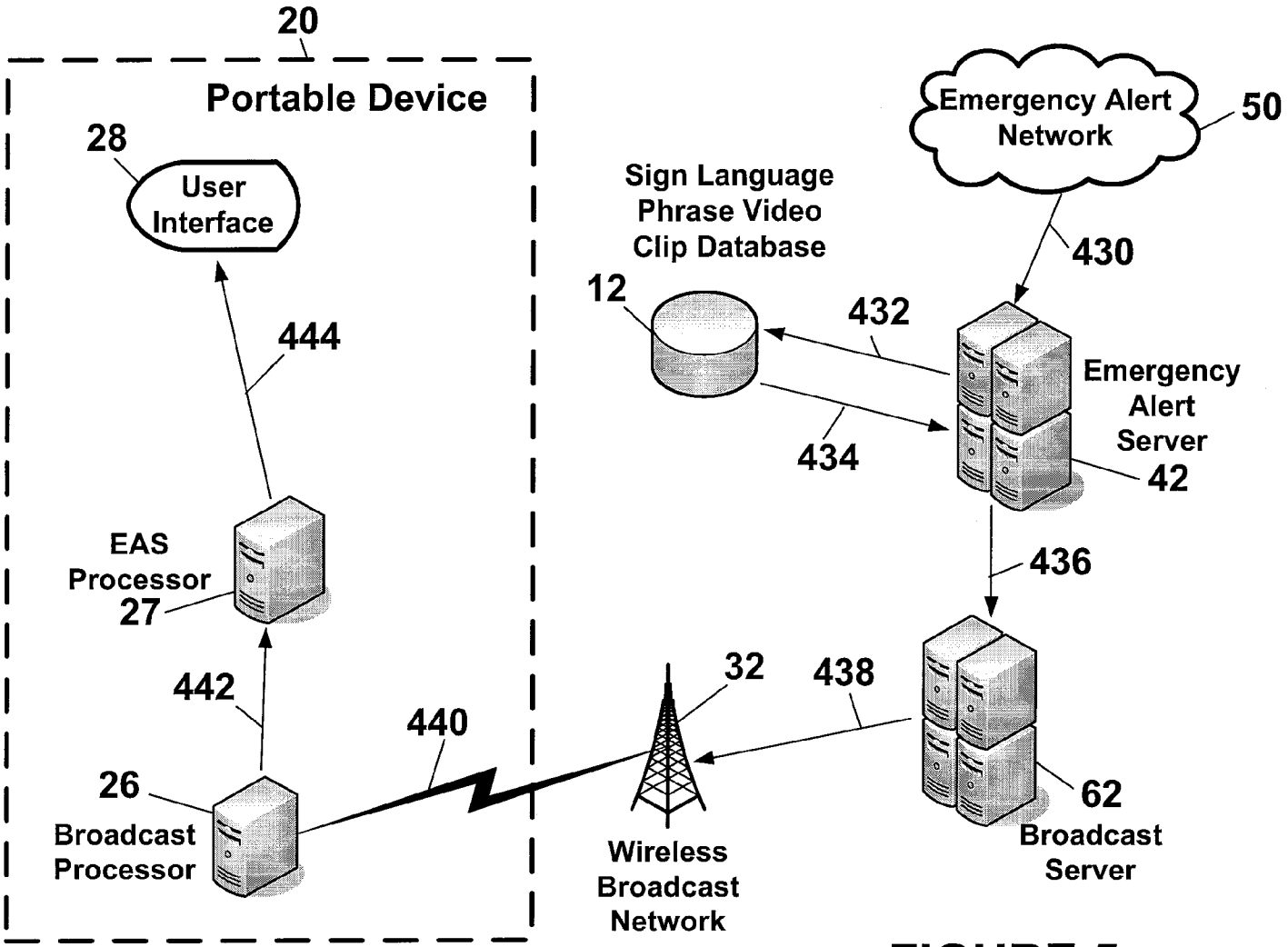
FIG. 5 is a flow diagram of an example network based system and process for delivering alert information via sign language.

FIG. 5 is a flow diagram of a network based system and process for providing an alert message via sign language. The emergency alert network 50 generates an emergency alert message and sends the alert message to the emergency alert server 42 at step 430. The emergency alert server 42 extracts the appropriate words, phrases, and the like, from the emergency alert message received at step 430. At step 432, the emergency alert server 42 provides a request to the sign language phrase video clip database 12 for the sign language video clip, or clips, corresponding to the extracted words, phrases, and the like. At step 434, the sign language phrase video clip database 12 provides the corresponding video clip(s) to the emergency alert server 42.

In an example embodiment, the emergency alert server 42 repeats step 432 for each word/phrase in the emergency alert message. That is, the emergency alert server 42 requests, for each word/phrase, or the like, a corresponding video clip, or clips, from the sign language phrase video clip database 12. In another example embodiment, the emergency alert server 42 provides a request to the sign language phrase video clip database 12, at step 432, for the video clip(s) corresponding to the entire emergency alert message and the sign language phrase video clip database 12 responds, at step 434, with sign language video clips indicative of the entire emergency alert message.

The emergency alert server 42 combines the received sign language video clips for the words/phrases into one video clip for the entire emergency alert message. The emergency alert server 42 can combine the received video clips in any appropriate manner, such as concatenation, or any other appropriate combining technique. The emergency alert server 42 provides, at step 436, to the broadcast server 62 for transmission to the cell sites within the associated alert area, the combined sign language video clips indicative of the emergency alert message. In an example, the emergency alert server 42 provides to the broadcast server 62 for transmission to the cell sites within the associated alert area, at step 436, the emergency alert message along with the combined sign language video clips indicative of the emergency alert message.

At step 438, the broadcast server 62 provides the combined sign language video clips indicative of the emergency alert message or the emergency alert message along with the combined sign language video clips indicative of the emergency alert message to the wireless broadcast network 32 for transmission to the indicated cell sites. At step 440, the broadcast processor 26 on the portable device 20 receives the combined sign language video clips indicative of the alert message or the emergency alert message along with the combined sign language video clips indicative of the emergency alert message from the wireless broadcast network 32. The broadcast processor 26 on the portable device 20 provides the combined sign language video clips indicative of the emergency alert message or the emergency alert message along with the combined sign language video clips indicative of the emergency alert message to the EAS processor 27, at step 442. At step 444, the EAS processor 27 provides, to the user interface 28, the combined sign language video clips indicative of the emergency alert message or the emergency alert message along with the combined sign language video clips indicative of the emergency alert message. The user interface 28 renders the combined sign language video clips which are indicative of at least a portion of the emergency alert message, which in turn is indicative of at least a portion of the emergency alert broadcast.

The following description sets forth some exemplary telephony radio networks and non-limiting operating environments for the EAS alert reporting services of the notification system for alerting users of portable devices of emergencies. The below-described operating environments should be considered non-exhaustive, however, and thus the below-described network architectures merely show how the services of the notification system for alerting users having disabilities of emergencies via portable devices may be incorporated into existing network structures and architectures. It can be appreciated, however, that the notification system can be incorporated into existing and/or future alternative architectures for communication networks as well.

The global system for mobile communication ("GSM") is one of the most widely utilized wireless access systems in today's fast growing communication environment. The GSM provides circuit-switched data services to subscribers, such as mobile telephone or computer users. The General Packet Radio Service ("GPRS"), which is an extension to GSM technology, introduces packet switching to GSM networks. The GPRS uses a packet-based wireless communication technology to transfer high and low speed data and signaling in an efficient manner. The GPRS attempts to optimize the use of network and radio resources, thus enabling the cost effective and efficient use of GSM network resources for packet mode applications.

As one of ordinary skill in the art can appreciate, the exemplary GSM/GPRS environment and services described herein also can be extended to 3G services, such as Universal Mobile Telephone System ("UMTS"), Frequency Division Duplexing ("FDD") and Time Division Duplexing ("TDD"), High Speed Packet Data Access ("HSPDA"), cdma2000 1x Evolution Data Optimized ("EVDO"), Code Division Multiple Access-2000 ("cdma2000 3x"), Time Division Synchronous Code Division Multiple Access ("TD-SCDMA"), Wideband Code Division Multiple Access ("WCDMA"), Enhanced Data GSM Environment ("EDGE"), International Mobile Telecommunications-2000 ("IMT-2000"), Digital Enhanced Cordless Telecommunications ("DECT"), etc., as well as to other network services that become available in time. In this regard, the techniques of the notification system for alerting users of portable devices of emergencies can be applied independently of the method of data transport, and do not depend on any particular network architecture, or underlying protocols.

Figure 6:
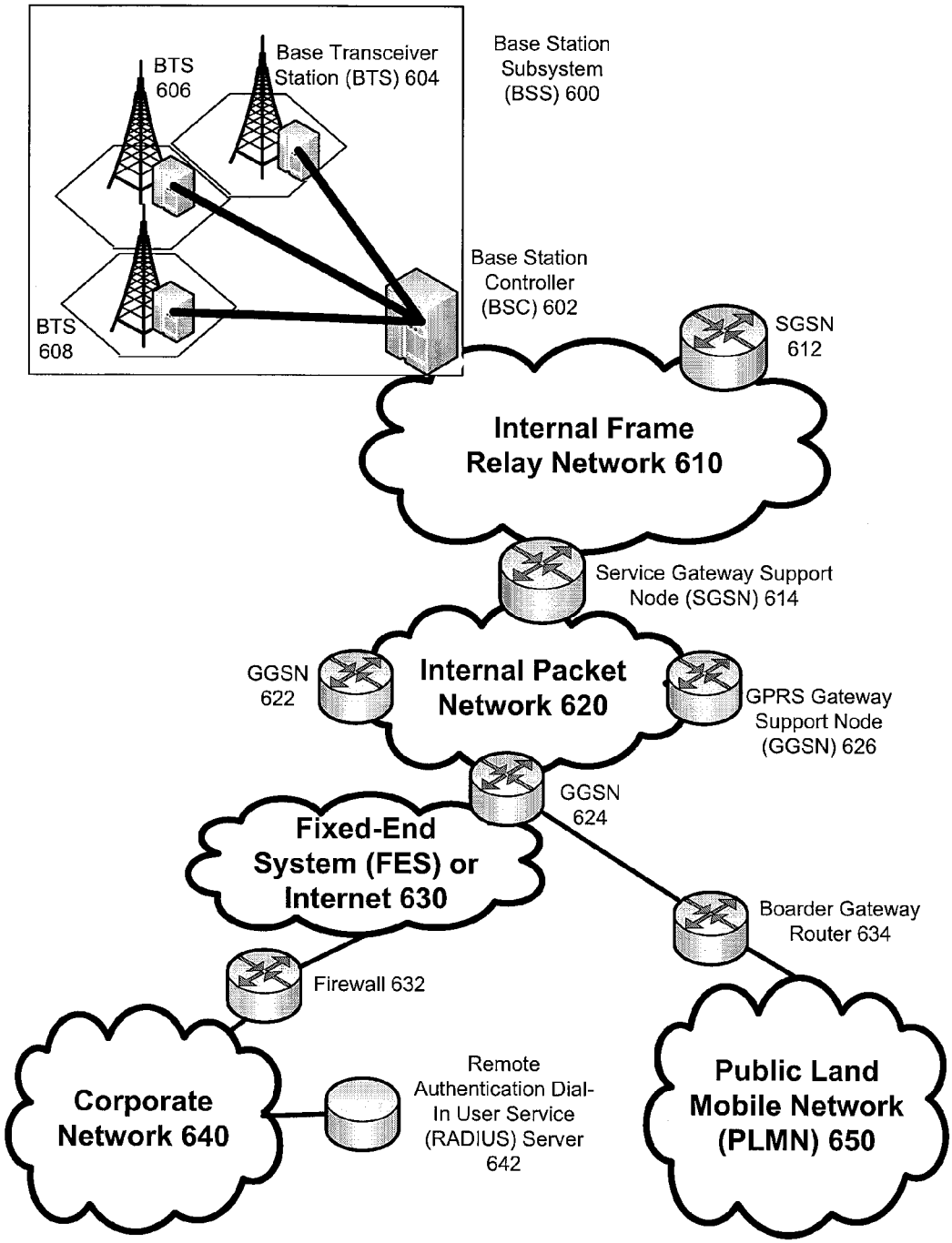
FIG. 6 illustrates an overview of an example network environment suitable for service by the emergency notification system for a portable device of a user having a disability.

FIG. 6 depicts an overall block diagram of an exemplary packet-based mobile cellular network environment, such as a GPRS network, in which the notification system for alerting disabled users of portable devices of emergencies can be practiced. In an example configuration, the telephony radio network 30, the emergency alert interface server/services 60, the emergency alert network 50, and the broadcast network 60 are encompassed by the network environment depicted in FIG. 6. In such an environment, there are a plurality of Base Station Subsystems ("BSS") 600 (only one is shown), each of which comprises a Base Station Controller ("BSC") 602 serving a plurality of Base Transceiver Stations ("BTS") such as BTSs 604, 606, and 608. BTSs 604, 606, 608, etc. are the access points where users of packet-based mobile devices (e.g., portable device 20) become connected to the wireless network. In exemplary fashion, the packet traffic originating from user devices (e.g., user device 20) is transported via an over-the-air interface to a BTS 608, and from the BTS 608 to the BSC 602. Base station subsystems, such as BSS 600, are a part of internal frame relay network 610 that can include Service GPRS Support Nodes ("SGSN") such as SGSN 612 and 614. Each SGSN is connected to an internal packet network 620 through which a SGSN 612, 614, etc. can route data packets to and from a plurality of gateway GPRS support nodes (GGSN) 622, 624, 626, etc. As illustrated, SGSN 614 and GGSNs 622, 624, and 626 are part of internal packet network 620. Gateway GPRS serving nodes 622, 624 and 626 mainly provide an interface to external Internet Protocol ("IP") networks such as Public Land Mobile Network ("PLMN") 650, corporate intranets 640, or Fixed-End System ("FES") or the public Internet 630. As illustrated, subscriber corporate network 640 may be connected to GGSN 624 via firewall 632; and PLMN 650 is connected to GGSN 624 via boarder gateway router 634. The Remote Authentication Dial-In User Service ("RADIUS") server 642 may be used for caller authentication when a user of a mobile cellular device calls corporate network 640.

Generally, there can be four different cell sizes in a GSM network, referred to as macro, micro, pico, and umbrella cells. The coverage area of each cell is different in different environments. Macro cells can be regarded as cells in which the base station antenna is installed in a mast or a building above average roof top level. Micro cells are cells whose antenna height is under average roof top level. Micro-cells are typically used in urban areas. Pico cells are small cells having a diameter of a few dozen meters. Pico cells are used mainly indoors. On the other hand, umbrella cells are used to cover shadowed regions of smaller cells and fill in gaps in coverage between those cells.

Figure 7:
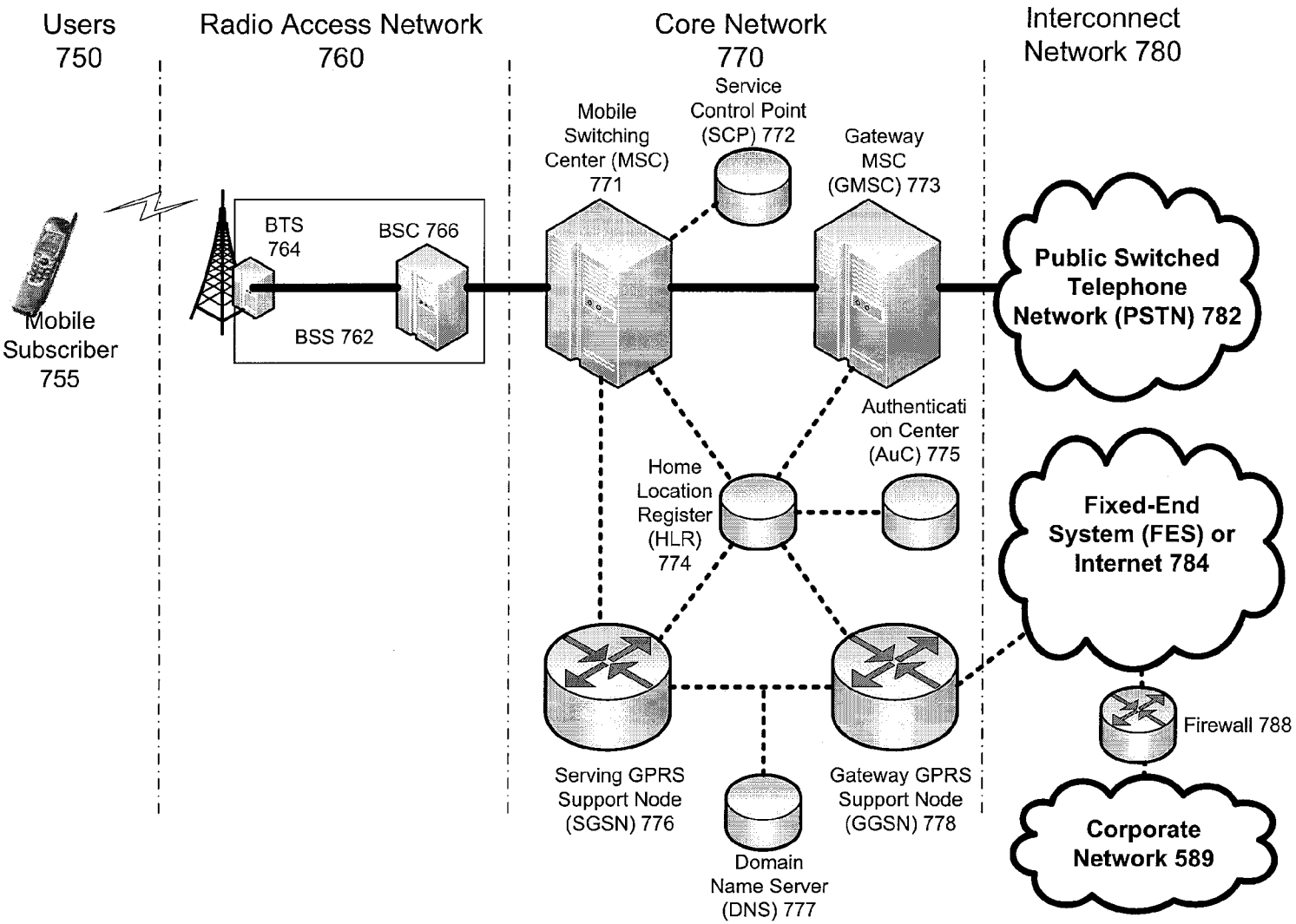
FIG. 7 illustrates an example GPRS network architecture that may incorporate various aspects of the emergency notification system for a portable device of a user having a disability.

FIG. 7 illustrates an architecture of a typical GPRS network as segmented into four groups: users 750, radio access network 760, core network 770, and interconnect network 780. In an example configuration the telephony radio network 30, the emergency alert interface server/services 40, the emergency alert network 70, and the broadcast network 60 are encompassed by the radio access network 760, core network 770, and interconnect network 780. Users 750 comprise a plurality of end users (though only mobile subscriber 755 is shown in FIG. 7). In an example embodiment, the device depicted as mobile subscriber 755 comprises portable device 20. Radio access network 760 comprises a plurality of base station subsystems such as BSSs 762, which include BTSs 764 and BSCs 766. Core network 770 comprises a host of various network elements. As illustrated here, core network 770 may comprise Mobile Switching Center ("MSC") 771, Service Control Point ("SCP") 772, gateway MSC 773, SGSN 776, Home Location Register ("HLR") 774, Authentication Center ("AuC") 775, Domain Name Server ("DNS") 777, and GGSN 778. Interconnect network 780 also comprises a host of various networks and other network elements. As illustrated in FIG. 7, interconnect network 780 comprises Public Switched Telephone Network ("PSTN") 782, Fixed-End System ("FES") or Internet 784, firewall 788, and Corporate Network 789.

A mobile switching center can be connected to a large number of base station controllers. At MSC 771, for instance, depending on the type of traffic, the traffic may be separated in that voice may be sent to Public Switched Telephone Network ("PSTN") 782 through Gateway MSC ("GMSC") 773, and/or data may be sent to SGSN 776, which then sends the data traffic to GGSN 778 for further forwarding.

When MSC 771 receives call traffic, for example, from BSC 766, it sends a query to a database hosted by SCP 772. The SCP 772 processes the request and issues a response to MSC 771 so that it may continue call processing as appropriate.

The HLR 774 is a centralized database for users to register to the GPRS network. HLR 774 stores static information about the subscribers such as the International Mobile Subscriber Identity ("IMSI"), subscribed services, and a key for authenticating the subscriber. HLR 774 also stores dynamic subscriber information such as the current location of the mobile subscriber. Associated with HLR 774 is AuC 775. AuC 775 is a database that contains the algorithms for authenticating subscribers and includes the associated keys for encryption to safeguard the user input for authentication.

In the following, depending on context, the term "mobile subscriber" sometimes refers to the end user, such as the user having a disability for example, and sometimes to the actual portable device, such as the portable device 20, used by an end user of the mobile cellular service. When a mobile subscriber turns on his or her mobile device, the mobile device goes through an attach process by which the mobile device attaches to an SGSN of the GPRS network. In FIG. 7, when mobile subscriber 755 initiates the attach process by turning on the network capabilities of the mobile device, an attach request is sent by mobile subscriber 755 to SGSN 776. The SGSN 776 queries another SGSN, to which mobile subscriber 755 was attached before, for the identity of mobile subscriber 755. Upon receiving the identity of mobile subscriber 755 from the other SGSN, SGSN 776 requests more information from mobile subscriber 755. This information is used to authenticate mobile subscriber 755 to SGSN 776 by HLR 774. Once verified, SGSN 776 sends a location update to HLR 774 indicating the change of location to a new SGSN, in this case SGSN 776. HLR 774 notifies the old SGSN, to which mobile subscriber 755 was attached before, to cancel the location process for mobile subscriber 755. HLR 774 then notifies SGSN 776 that the location update has been performed. At this time, SGSN 776 sends an Attach Accept message to mobile subscriber 755, which in turn sends an Attach Complete message to SGSN 776.

After attaching itself with the network, mobile subscriber 755 then goes through the authentication process. In the authentication process, SGSN 776 sends the authentication information to HLR 774, which sends information back to SGSN 776 based on the user profile that was part of the user's initial setup. The SGSN 776 then sends a request for authentication and ciphering to mobile subscriber 755. The mobile subscriber 755 uses an algorithm to send the user identification (ID) and password to SGSN 776. The SGSN 776 uses the same algorithm and compares the result. If a match occurs, SGSN 776 authenticates mobile subscriber 755.

Next, the mobile subscriber 755 establishes a user session with the destination network, corporate network 789, by going through a Packet Data Protocol ("PDP") activation process. Briefly, in the process, mobile subscriber 755 requests access to the Access Point Name ("APN"), for example, UPS.com (e.g., which can be corporate network 789 in FIG. 3) and SGSN 776 receives the activation request from mobile subscriber 755. SGSN 776 then initiates a Domain Name Service ("DNS") query to learn which GGSN node has access to the UPS.com APN. The DNS query is sent to the DNS server within the core network 770, such as DNS 777, which is provisioned to map to one or more GGSN nodes in the core network 770. Based on the APN, the mapped GGSN 778 can access the requested corporate network 789. The SGSN 776 then sends to GGSN 778 a Create Packet Data Protocol ("PDP") Context Request message that contains necessary information. The GGSN 778 sends a Create PDP Context Response message to SGSN 776, which then sends an Activate PDP Context Accept message to mobile subscriber 755.

Once activated, data packets of the call made by mobile subscriber 755 can then go through radio access network 760, core network 770, and interconnect network 780, in a particular fixed-end system or Internet 784 and firewall 788, to reach corporate network 789.

Thus, network elements that can invoke the functionality of the EAS alert reporting in accordance the emergency notification system for a portable device of a user having a disability can include but are not limited to Gateway GPRS Support Node tables, Fixed End System router tables, firewall systems, VPN tunnels, and any number of other network elements as required by the particular digital network.

Figure 8:
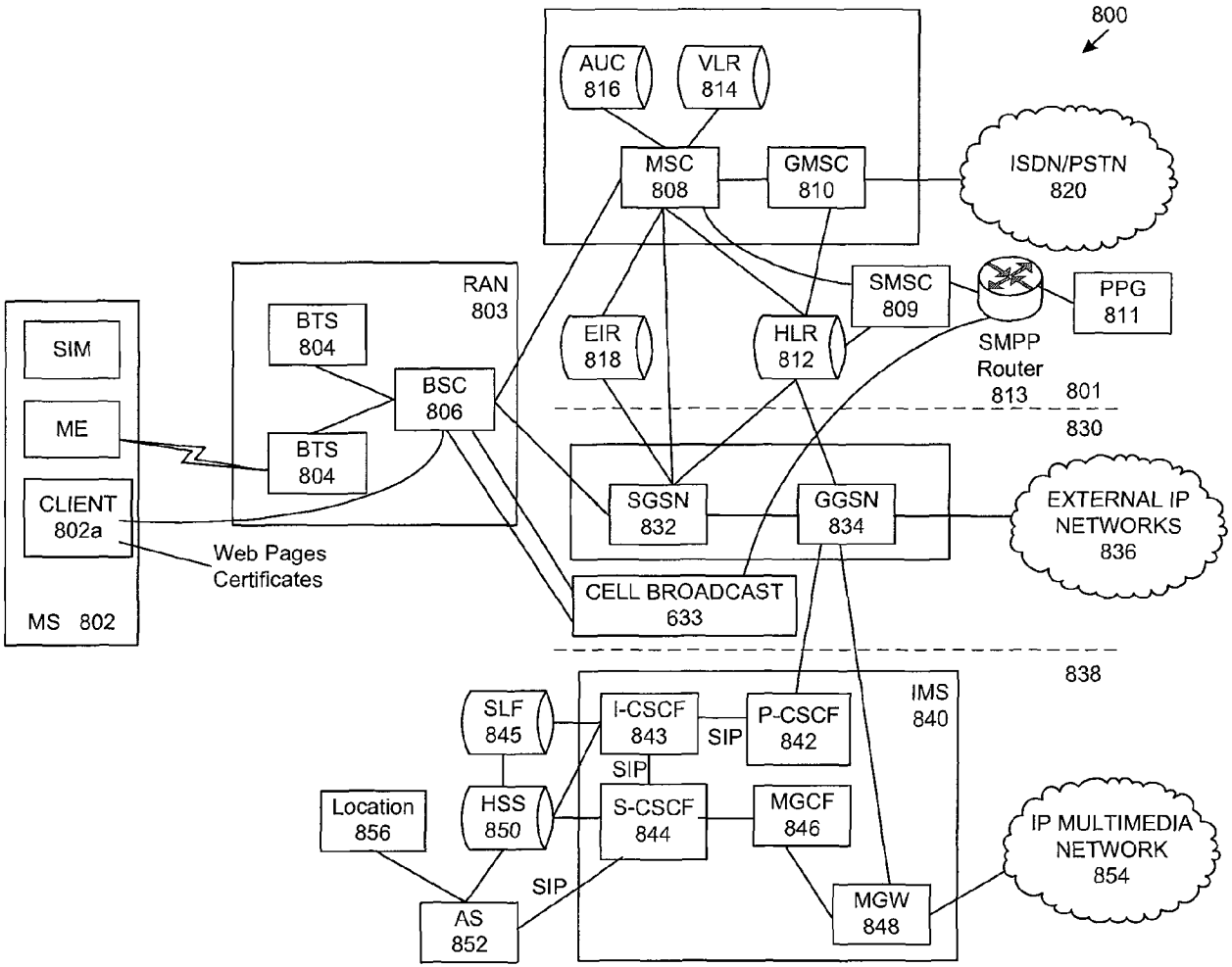
FIG. 8 illustrates an example alternate block diagram of an exemplary GSM/GPRS/IP multimedia network architecture in which the emergency notification system for a portable device of a user having a disability may be employed.

FIG. 8 illustrates another exemplary block diagram view of a GSM/GPRS/IP multimedia network architecture 800 in which EAS alerting and reporting of the notification system for alerting users of portable devices of emergencies may be incorporated. As illustrated, architecture 800 of FIG. 8 includes a GSM core network 801, a GPRS network 830 and an IP multimedia network 838. The GSM core network 801 includes a Mobile Station (MS) 802, at least one Base Transceiver Station (BTS) 804 and a Base Station Controller (BSC) 806. The MS 802 is physical equipment or Mobile Equipment (ME), such as a mobile phone or a laptop computer (e.g., portable device 20) that is used by mobile subscribers, with a Subscriber identity Module (SIM). The SIM includes an International Mobile Subscriber Identity (IMSI), which is a unique identifier of a subscriber. The BTS 804 is physical equipment, such as a radio tower, that enables a radio interface to communicate with the MS. Each BTS may serve more than one MS. The BSC 806 manages radio resources, including the BTS. The BSC may be connected to several BTSs. The BSC and BTS components, in combination, are generally referred to as a base station (BSS) or radio access network (RAN) 803.

The GSM core network 801 also includes a Mobile Switching Center (MSC) 808, a Gateway Mobile Switching Center (GMSC) 810, a Home Location Register (HLR) 812, Visitor Location Register (VLR) 814, an Authentication Center (AuC) 818, and an Equipment Identity Register (EIR) 816. The MSC 808 performs a switching function for the network. The MSC also performs other functions, such as registration, authentication, location updating, handovers, and call routing. The GMSC 810 provides a gateway between the GSM network and other networks, such as an Integrated Services Digital Network (ISDN) or Public Switched Telephone Networks (PSTNs) 820. Thus, the GMSC 810 provides interworking functionality with external networks.

The HLR 812 is a database that contains administrative information regarding each subscriber registered in a corresponding GSM network. The HLR 812 also contains the current location of each MS. The VLR 814 is a database that contains selected administrative information from the HLR 812. The VLR contains information necessary for call control and provision of subscribed services for each MS currently located in a geographical area controlled by the VLR. The HLR 812 and the VLR 814, together with the MSC 808, provide the call routing and roaming capabilities of GSM. The AuC 816 provides the parameters needed for authentication and encryption functions. Such parameters allow verification of a subscriber's identity. The EIR 818 stores security-sensitive information about the mobile equipment.

A Short Message Service Center (SMSC) 809 allows one-to-one Short Message Service (SMS) messages to be sent to/from the MS 802. A Push Proxy Gateway (PPG) 811 is used to "push" (i.e., send without a synchronous request) content to the MS 802. The PPG 811 acts as a proxy between wired and wireless networks to facilitate pushing of data to the MS 802. A Short Message Peer to Peer (SMPP) protocol router 813 is provided to convert SMS-based SMPP messages to cell broadcast messages. SMPP is a protocol for exchanging SMS messages between SMS peer entities such as short message service centers. The SMPP protocol is often used to allow third parties, e.g., content suppliers such as news organizations, to submit bulk messages.

To gain access to GSM services, such as speech, data, and short message service (SMS), the MS first registers with the network to indicate its current location by performing a location update and IMSI attach procedure. The MS 802 sends a location update including its current location information to the MSC/VLR, via the BTS 804 and the BSC 806. The location information is then sent to the MS's HLR. The HLR is updated with the location information received from the MSC/VLR. The location update also is performed when the MS moves to a new location area. Typically, the location update is periodically performed to update the database as location updating events occur.

The GPRS network 830 is logically implemented on the GSM core network architecture by introducing two packet-switching network nodes, a serving GPRS support node (SGSN) 832, a cell broadcast and a Gateway GPRS support node (GGSN) 834. The SGSN 832 is at the same hierarchical level as the MSC 808 in the GSM network. The SGSN controls the connection between the GPRS network and the MS 802. The SGSN also keeps track of individual MS's locations and security functions and access controls.

A Cell Broadcast Center (CBC) 833 communicates cell broadcast messages that are typically delivered to multiple users in a specified area. Cell Broadcast is one-to-many geographically focused service. It enables messages to be communicated to multiple mobile phone customers who are located within a given part of its network coverage area at the time the message is broadcast.

The GGSN 834 provides a gateway between the GPRS network and a public packet network (PDN) or other IP networks 836. That is, the GGSN provides interworking functionality with external networks, and sets up a logical link to the MS through the SGSN. When packet-switched data leaves the GPRS network, it is transferred to an external TCP-IP network 836, such as an X.25 network or the Internet. In order to access GPRS services, the MS first attaches itself to the GPRS network by performing an attach procedure. The MS then activates a packet data protocol (PDP) context, thus activating a packet communication session between the MS, the SGSN, and the GGSN.

In a GSM/GPRS network, GPRS services and GSM services can be used in parallel. The MS can operate in one three classes: class A, class B, and class C. A class A MS can attach to the network for both GPRS services and GSM services simultaneously. A class A MS also supports simultaneous operation of GPRS services and GSM services. For example, class A mobiles can receive GSM voice/data/SMS calls and GPRS data calls at the same time.

A class B MS can attach to the network for both GPRS services and GSM services simultaneously. However, a class B MS does not support simultaneous operation of the GPRS services and GSM services. That is, a class B MS can only use one of the two services at a given time.

A class C MS can attach for only one of the GPRS services and GSM services at a time. Simultaneous attachment and operation of GPRS services and GSM services is not possible with a class C MS.

A GPRS network 830 can be designed to operate in three network operation modes (NOM1, NOM2 and NOM3). A network operation mode of a GPRS network is indicated by a parameter in system information messages transmitted within a cell. The system information messages dictates a MS where to listen for paging messages and how signal towards the network. The network operation mode represents the capabilities of the GPRS network. In a NOM1 network, a MS can receive pages from a circuit switched domain (voice call) when engaged in a data call. The MS can suspend the data call or take both simultaneously, depending on the ability of the MS. In a NOM2 network, a MS may not received pages from a circuit switched domain when engaged in a data call, since the MS is receiving data and is not listening to a paging channel In a NOM3 network, a MS can monitor pages for a circuit switched network while received data and vise versa.

The IP multimedia network 838 was introduced with 3GPP Release 5, and includes an IP multimedia subsystem (IMS) 840 to provide rich multimedia services to end users. A representative set of the network entities within the IMS 840 are a call/session control function (CSCF), a media gateway control function (MGCF) 846, a media gateway (MGW) 848, and a master subscriber database, called a home subscriber server (HSS) 850. The HSS 850 may be common to the GSM network 801, the GPRS network 830 as well as the IP multimedia network 838.

The IP multimedia system 840 is built around the call/session control function, of which there are three types: an interrogating CSCF (I-CSCF) 843, a proxy CSCF (P-CSCF) 842, and a serving CSCF (S-CSCF) 844. The P-CSCF 842 is the MS's first point of contact with the IMS 840. The P-CSCF 842 forwards session initiation protocol (SIP) messages received from the MS to an SIP server in a home network (and vice versa) of the MS. The P-CSCF 842 may also modify an outgoing request according to a set of rules defined by the network operator (for example, address analysis and potential modification).

The I-CSCF 843, forms an entrance to a home network and hides the inner topology of the home network from other networks and provides flexibility for selecting an S-CSCF. The I-CSCF 843 may contact a subscriber location function (SLF) 845 to determine which HSS 850 to use for the particular subscriber, if multiple HSS's 850 are present. The S-CSCF 844 performs the session control services for the MS 802. This includes routing originating sessions to external networks and routing terminating sessions to visited networks. The S-CSCF 844 also decides whether an application server (AS) 852 is required to receive information on an incoming SIP session request to ensure appropriate service handling. This decision is based on information received from the HSS 850 (or other sources, such as an application server 852). The AS 852 also communicates to a location server 856 (e.g., a Gateway Mobile Location Center (GMLC)) that provides a position (e.g., latitude/longitude coordinates) of the MS 802.

The HSS 850 contains a subscriber profile and keeps track of which core network node is currently handling the subscriber. It also supports subscriber authentication and authorization functions (AAA). In networks with more than one HSS 850, a subscriber location function provides information on the HSS 850 that contains the profile of a given subscriber.

The MGCF 846 provides interworking functionality between SIP session control signaling from the IMS 840 and ISUP/BICC call control signaling from the external GSTN networks (not shown). It also controls the media gateway (MGW) 848 that provides user-plane interworking functionality (e.g., converting between AMR- and PCM-coded voice). The MGW 848 also communicates with other IP multimedia networks 854.

Push to Talk over Cellular (PoC) capable mobile phones register with the wireless network when the phones are in a predefined area (e.g., job site, etc.). When the mobile phones leave the area, they register with the network in their new location as being outside the predefined area. This registration, however, does not indicate the actual physical location of the mobile phones outside the pre-defined area.

While example embodiments a notification system for alerting disabled users of portable devices of emergencies have been described in connection with various computing devices, the underlying concepts can be applied to any computing device or system capable of providing a notification for alerting disabled users of portable devices of emergencies. The various techniques described herein can be implemented in connection with hardware or software or, where appropriate, with a combination of both. Thus, the methods and apparatus for a notification system for alerting disabled users of portable devices of emergencies, or certain aspects or portions thereof, can take the form of program code (i.e., instructions) embodied in tangible media, such as floppy diskettes, CD-ROMs, hard drives, or any other machine-readable storage medium, wherein, when the program code is loaded into and executed by a machine, such as a computer, the machine becomes an apparatus for providing a notification for alerting disabled users of portable devices of emergencies. In the case of program code execution on programmable computers, the computing device will generally include a processor, a storage medium readable by the processor (including volatile and non-volatile memory and/or storage elements), at least one input device, and at least one output device. The program(s) can be implemented in assembly or machine language, if desired. In any case, the language can be a compiled or interpreted language, and combined with hardware implementations.

The methods and apparatus for a notification system for alerting disabled users of portable devices of emergencies also can be practiced via communications embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, or the like, the machine becomes an apparatus for a notification system for alerting disabled users of portable devices of emergencies. When implemented on a general-purpose processor, the program code combines with the processor to provide a unique apparatus that operates to invoke the functionality of a notification system for alerting disabled users of portable devices of emergencies. Additionally, any storage techniques used in connection with a notification system for alerting disabled users of portable devices of emergencies can invariably be a combination of hardware and software.

While a notification system for alerting disabled users of portable devices of emergencies has been described in connection with the various embodiments of the various figures, it is to be understood that other similar embodiments can be used or modifications and additions can be made to the described embodiment for performing the same function of the notification system for alerting disabled users of portable devices of emergencies without deviating therefrom. For example, one skilled in the art will recognize that the notification system for alerting users of portable devices of emergencies as described in the present application may apply to any environment, whether wired or wireless, and may be applied to any number of such devices connected via a communications network and interacting across the network.

Therefore, the notification system for alerting disabled users of portable devices of emergencies should not be limited to any single embodiment, but rather should be construed in breadth and scope in accordance with the appended claims.

What is claimed:

1. A method for providing an emergency message, the method comprising:

receiving a message indicative of an emergency;

selecting content for extraction from the message;

extracting the selected content from the message;

retrieving a plurality of video clips, each of the plurality of video clips representative of at least a portion of the extracted content;

combining the plurality of video clips; and providing the combined video clips and the message in accordance with an alert messaging scheme.

2. The method of claim 1, wherein each of the plurality of video clips comprises a translation of a respective portion of the extracted content.

3. The method of claim 2, wherein the translations are sign language translations.

4. The method of claim 1, wherein the content is selected in accordance with the alert messaging scheme.

5. The method of claim 1, wherein the extracted content comprises an entirety of the message.

6. A network enabled alerting device comprising:

a line interface configured to receive a message from an alerting service; and an alerting processor configured to:

select content for extraction from the message;

extract the selected content from the message;

retrieve a plurality of video clips, each of the plurality of video clips representative of at least a portion of the extracted content;

combine the plurality of video clips; and provide the combined video clips and the message in accordance with an alert messaging scheme.

7. The device of claim 6, wherein each of the plurality of video clips comprises a translation of a respective portion of the extracted content.

8. The device of claim 7, wherein the translations are sign language translations.

9. The device of claim 6, wherein the content is selected in accordance with the alert messaging scheme.

10. The device of claim 6, wherein the extracted content comprises an entirety of the message.

11. A computer readable storage medium with computer executable instructions stored thereon that, when executed by a processor, perform a method for providing an emergency message, the method comprising:

receiving a message indicative of an emergency;

selecting content for extraction from the message;

extracting the selected content from the message;

retrieving a plurality of video clips, each of the plurality of video clips representative of at least a portion of the extracted content;

combining the plurality of video clips; and providing the combined video clips and the message in accordance with an alert messaging scheme.

12. The computer readable storage medium of claim 11, wherein each of the plurality of video clips comprises a translation of a respective portion of the extracted content.

13. The computer readable storage medium of claim 12, wherein the translations are sign language translations.

14. The computer readable storage medium of claim 11, wherein the content is selected in accordance with the alert messaging scheme.

15. The computer readable storage medium of claim 11, wherein the extracted content comprises an entirety of the message.

* * * * *